US007081861B2

(12) United States Patent
Steyn et al.

(10) Patent No.: US 7,081,861 B2
(45) Date of Patent: Jul. 25, 2006

(54) PHASED ARRAY ANTENNA

(75) Inventors: Pierre Steyn, Westlake (ZA); William Ian George, Fish Hoek (ZA); Johannes Arnoldus Pretorius, Constania (ZA); Max Lariviere Birch, Somerset West (ZA)

(73) Assignee: Chelton, Inc., Lewisville, TX (US)

( * ) Notice: Subject to any disclaimer, the term of this patent is extended or adjusted under 35 U.S.C. 154(b) by 0 days.

(21) Appl. No.: 10/512,650

(22) PCT Filed: Jan. 23, 2004

(86) PCT No.: PCT/IB2004/000157

§ 371 (c)(1),
(2), (4) Date: Oct. 25, 2004

(87) PCT Pub. No.: WO2004/066436

PCT Pub. Date: Aug. 5, 2004

(65) Prior Publication Data

US 2005/0162326 A1 Jul. 28, 2005

(30) Foreign Application Priority Data

Jan. 23, 2003 (ZA) ..... 2003/0631

(51) Int. Cl.
*H01Q 13/10* (2006.01)

(52) U.S. Cl. ..... 343/770; 343/853

(58) Field of Classification Search ..... 343/767, 343/770, 853, 797

See application file for complete search history.

(56) References Cited

U.S. PATENT DOCUMENTS

| | | | | |
|---|---|---|---|---|
| 4,916,457 | A * | 4/1990 | Foy et al. | 343/770 |
| 6,304,226 | B1 * | 10/2001 | Brown et al. | 343/767 |
| 6,351,247 | B1 * | 2/2002 | Linstrom et al. | 343/797 |
| 6,388,621 | B1 * | 5/2002 | Lynch | 343/700 MS |
| 6,501,426 | B1 | 12/2002 | Waterman | |
| 6,507,320 | B1 * | 1/2003 | Von Stein et al. | 343/770 |
| 6,593,891 | B1 * | 7/2003 | Zhang | 343/767 |
| 6,646,618 | B1 * | 11/2003 | Sievenpiper | 343/770 |
| 6,741,214 | B1 * | 5/2004 | Kadambi et al. | 373/700 MS |

* cited by examiner

*Primary Examiner*—Tan Ho
(74) *Attorney, Agent, or Firm*—Jaeckle Fleischmann & Mugel, LLP

(57) ABSTRACT

The invention discloses an antenna system, which includes an array structure provided with a plurality of radiator elements being adapted to transmit and receive radiated electromagnetic waves. Each of the radiator elements are provided with at least two transverse interconnecting slots forming an aperture. An array feed network is operatively associated with each radiator element and is adapted to transmit a signal to and receive a signal from each radiator element and is further adapted to provide at least one common feed point for the array structure. A phase shifting unit operatively joins each radiator element to its associated feed point, the phase shifting unit being adapted to selectively adjust a phase of the electromagnetic waves associated with each radiator element. Operation of each phase shifting unit is regulated by control means for controlling the generation of a radiation pattern.

38 Claims, 3 Drawing Sheets

PHASED ARRAY ANTENNA

This application is a 371 of PCT/IB04/00157 filed on Jan. 23, 2004.

FIELD OF INVENTION

The present invention relates to an antenna.

More particularly, the invention relates to a low profile wide angle scanning circularly polarized phased array antenna.

BACKGROUND TO INVENTION

Antennas are designed to transmit and receive electromagnetic waves. Antennas for various purposes are continuously being further researched and developed.

A phased array antenna is an antenna with a directive radiation pattern which can be controlled by controlling individual radiator elements or groups of radiator elements in the antenna. In general, the steering direction of the radiation pattern is determined by control of the phases of the signal to or from the radiator elements. The phase control is achieved by phase shifters which should have low transmission loss.

One requirement for a phased array antenna is the provision of sufficient co-polarized gain over a wide range of scanning angles with sufficient beam sharpness and low side and grating lobe radiation. In this case wide angle scanning refers to from about 5° above the horizon up to 90° with the full 360° azimuth coverage. Such an antenna is primarily used in the aircraft industry where both profile height, surface area occupied and weight are important.

To achieve wide angle scanning without the appearance of grating lobes a very compact array element spacing is required. This in turn requires a compact, yet efficient, radiating element. Furthermore, to ensure low side lobe radiation the array antenna aperture should be tapered, i.e. the individual radiator elements occupying different positions within the array are excited with different magnitudes corresponding to the requited taper. This is implement by a array feed network.

The ability of a phased array antenna to provide the necessary wide angle scanning radiation is further a function of the ability of the individual radiating elements embedded within the array to radiate in the required direction. This is generally a problem when scanning just above the horizon as the individual radiators themselves within the array environment do not have a sufficiently wide radiation beamwidth to provide adequate gain in these directions.

A conventional phased array antenna's directivity can be determined by measuring the projected aperture of the antenna in a given direction. As the array is scanned to lower elevation angles the projected aperture becomes less. To achieve wide angle scanning the projected aperture in the low elevation regions is an important consideration and often requires that the antenna be much larger than desired.

Generally a close radiator spacing of radiating elements exuding high levels of low elevation gain results in high levels of mutual coupling between the elements. This mutual coupling, if not properly accounted for can often negatively influence the gain performance of the antenna.

Radiators with high levels of low elevation radiation are generally higher, such as various types of helices and dipoles that stand upright. These antenna elements have the advantage of occupying a small planar surface area facilitating a close radiator spacing. However these antennas are unsuited to a market where a lower profile height is desirable for both aerodynamic and aesthetic considerations.

It is an object of the invention to suggest an antenna, which will assist in overcoming these problems.

SUMMARY OF INVENTION

According to the invention, an antenna system includes a) an array structure provided with a plurality of radiator elements being adapted to transmit and receive radiated electromagnetic waves;

b) each radiator element being provided with at least two transverse interconnecting slots forming an aperture;

c) an array feed network operatively associated with each radiator element and being adapted to transmit a signal to and receive a signal from each radiator element and further being adapted to provide at least one common feed point for the array structure;

d) a phase shifting unit operatively joining each radiator element to its associated feed point, the phase shifting unit being adapted to selectively adjust a phase of the electromagnetic waves associated with each radiator element; and e) control means for regulating operation of each phase shifting unit and thereby controlling generation of a radiation pattern.

The radiation pattern may be a travelling wave array formation being adapted to enhance gain performance in lower elevation regions.

The gain performance may be enhanced when the travelling wave array formation is directed to within 30° of its horizon.

The array structure may be substantially in the form of a hexagonal grid wherein adjacent radiator elements are spaced apart by less than half a wavelength of the electromagnetic waves.

Each radiator element may be adapted to be circularly polarized and may be further adapted to generate circularly polarized electromagnetic waves.

Each radiator element may include a shell forming a conductive cavity, the shell extending above a conductive ground plane.

The ground plane may be planar or non-planar.

The conductive cavity may have a depth less than a quarter of a wavelength of the electromagnetic waves.

The conductive cavity may have a diameter less than a half of a wavelength of the electromagnetic waves.

The conductive cavity may be circular cylindrical or hexagonal cylindrical in shape.

Each transverse slot may have a length less than a half of a wavelength of the electromagnetic waves.

Each transverse slot may be adapted to be operatively excited with at least one excitation point provided at at least one end of each slot.

Each transverse slot may be radially offset relative to each other associated slot and each slot may be adapted to be excited with an appropriate phase relative to each other so as to generate circular polarization.

In an antenna system, in which two transverse slots are provided, one slot may be orthogonally orientated relative to the other slot and the slots may be adapted to be excited out of phase by 90° relative to each other so as to generate circular polarization.

Each radiator element may include a feed structure being adapted to excite each transverse slot.

Each feed structure may include a reactive transmission line circuit.

The transmission line circuit may include various transmission lines with different characteristics being adapted to achieve optimal circular polarisation of the radiation pattern when the array structure is directed to below 30° of its horizon.

Each feed structure may be located within the conductive cavity of its associated radiator element.

The array feed network may include a corporate configuration, a series configuration, or combination of a corporate and a series configuration.

The phase shifting unit may be adapted to permit spatial steering of the radiation pattern.

Each radiator element may include an operatively associated parasitic element.

Each parasitic element may be located above the transverse slots of its associated radiator element.

Each parasitic element may be provided in one of the following shapes: circular disc or ring, elliptical disc, square, spiral and may be formed into a planar, cylindrical, conical, spherical or saddle shape.

The parasitic element's size, shape and spacing may be selected for suitably manipulating mutual electromagnetic coupling prevalent between adjacent radiator elements to thereby obtain a desired radiation pattern.

The antenna system may include capacitive or inductive elements located between adjacent radiator elements and being adapted to manipulate mutual electromagnetic coupling prevalent between adjacent radiator elements to thereby obtain a desired radiation pattern.

The antenna system may include capacitive or inductive elements located along an outer perimeter of the array structure and being adapted to manipulate mutual electromagnetic coupling prevalent between adjacent radiator elements to thereby obtain a desired radiation pattern.

Also according to the invention, a radiator element for use in an antenna system and being adapted to receive radiated electromagnetic waves, includes a conductive ground plane; a shell forming a conductive cavity, the shell extending above the conductive ground plane and forming a wall spaced apart from the ground plane; at least two transverse slots provided in the wall and being adapted to form a crossed-slot aperture; and a parasitic element operatively associated with the transverse slots.

The radiator element may be adapted to be circularly polarized and is further adapted to generate circularly polarized electromagnetic waves.

The ground plane may be planar or non-planar.

The conductive cavity may have a depth less than a quarter of a wavelength of the electromagnetic waves.

The conductive cavity may have a diameter less than a half of a wavelength of the electromagnetic waves.

The conductive cavity may be circular cylindrical or hexagonal cylindrical in shape.

Each transverse slot may have a length less than a half of a wavelength of the electromagnetic waves.

Each transverse slot may be adapted to be operatively excited with at least one excitation point provided at at least one end of each slot.

Each slot may be radially offset relative to each other associated slot and each slot being adapted to be excited with an appropriate phase relative to each other so as to generate circular polarization.

In a radiator element, in which two transverse slots are provided, one slot may be orthogonally orientated relative to the other slot and the slots may be adapted to be excited out of phase by 90° relative to each other so as to generate circular polarization.

The radiator element may be provided with a feed structure being adapted to excite each transverse slot.

Each feed structure may include a reactive transmission line circuit.

The transmission line circuit may include various transmission lines with varying characteristics obtained by varying the lengths of the transmission lines.

Each feed structure may be located within the conductive cavity.

The parasitic element may be located above the transverse slots.

The parasitic element may be provided in one of the following shapes: circular disc or ring, elliptical disc, square, spiral, and which is formed into a planar, cylindrical, conical, spherical or saddle shape.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
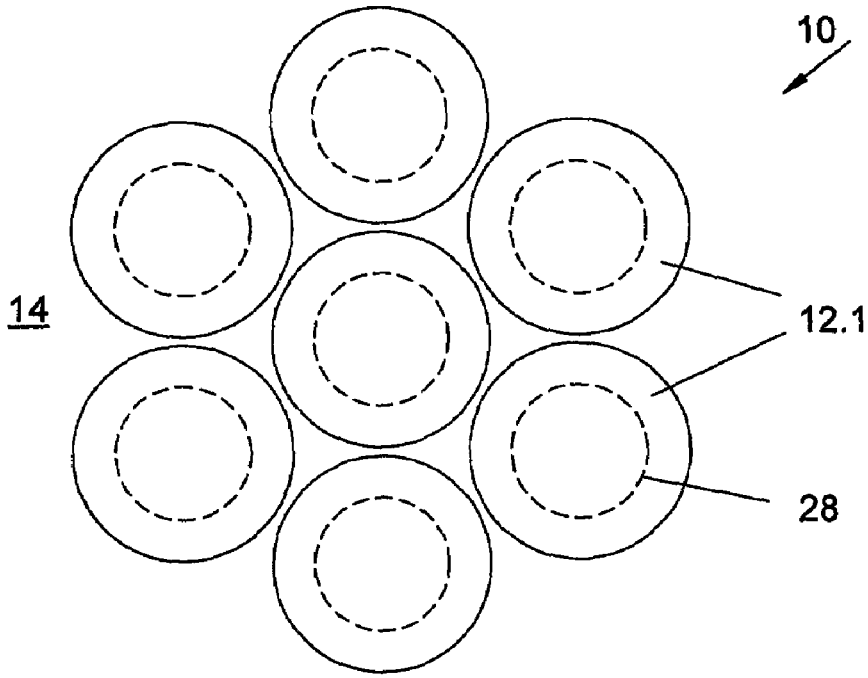
FIG. 1 an array antenna having circular cylindrical radiators elements in accordance with the invention.
Figure 2:
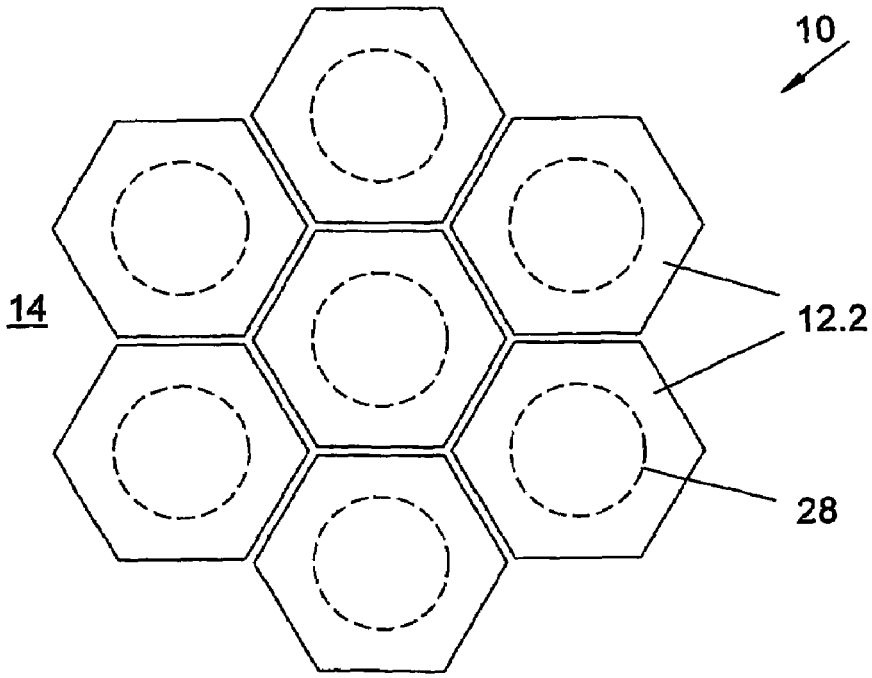
FIG. 2 an array antenna having hexagonal cylindrical radiators elements in accordance with the invention.

Referring to FIGS. 1 and 2, an antenna in accordance with the invention, generally indicated by reference numeral 10, is shown. The antenna 10 includes a number of circular cylindrical radiator elements 12.1, as shown in FIG. 1, or hexagonal cylindrical radiator elements 12.2, as shown in FIG. 2 arranged in an array on a conductive array base plane 14. Both the circular cylindrical radiator elements 12.1 and the hexagonal cylindrical radiator elements 12.2 allow compact, high-density packing of the radiator elements 12.1, 12.2, with minimum inter-element spacing in any direction.

Figure 3:
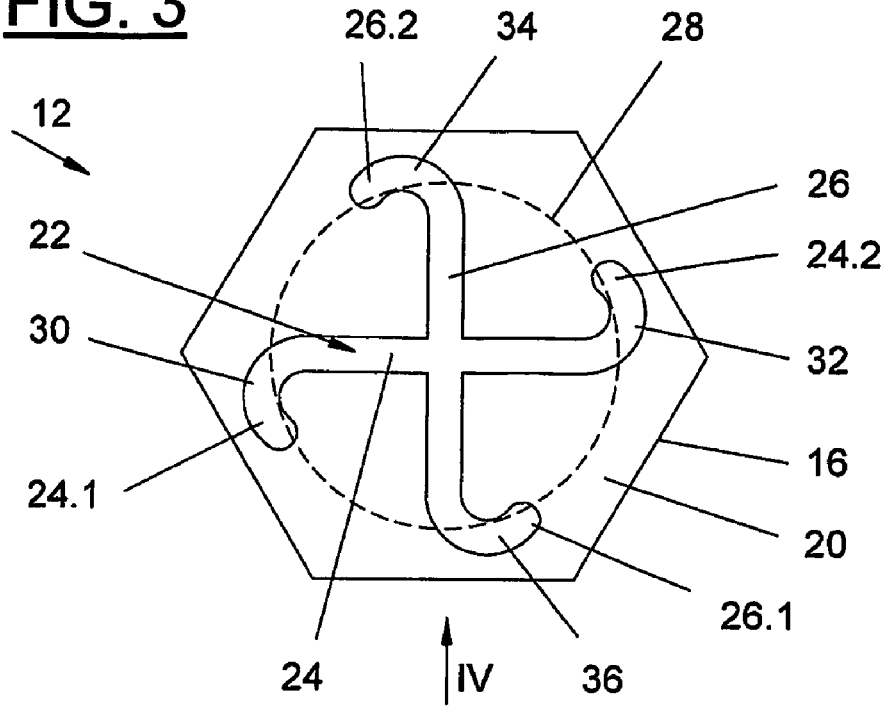
FIG. 3 on an enlarged scale, a plan view of one radiating element included in the antenna shown in FIG. 2.
Figure 4:
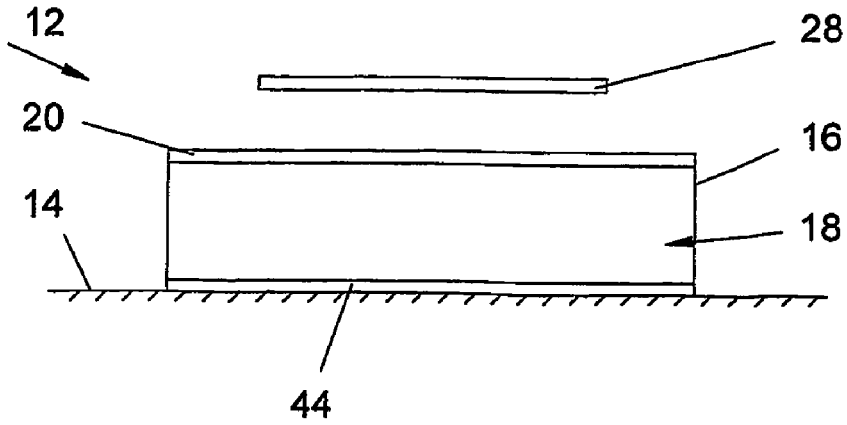
FIG. 4 a side view seen along arrow IV in FIG. 3.
Figure 5:
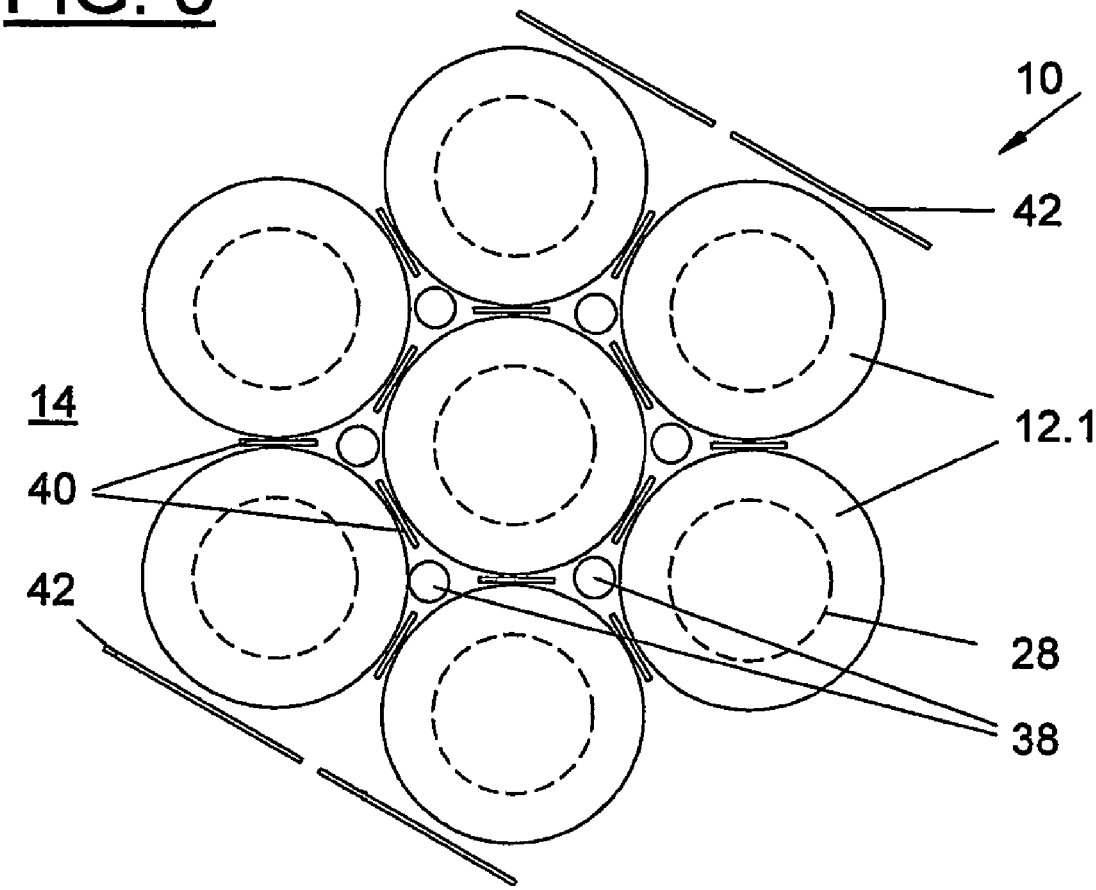
FIG. 5 an array antenna as shown in FIG. 1, being provided with various capacitive and inductive elements.

In FIGS. 3 and 4, one example of the radiator elements 12.2 is shown. The radiator element 12.2 includes a cavity shell 16 defining a conductive cavity 18, with the cavity shell 16 being enclosed. (The same would apply in case the radiator elements 12.1 shown in FIG. 1 are used.)

A wall or lid 20 is provided on one side of the cavity shell 16 opposite to the base plane 14, so that the lid 20 is spaced apart from the base plane 14 by less than a quarter of a free-space wavelength at the design frequency. The lid 20 has a cross-shaped aperture 22 formed therein, the aperture 22 having two slots 24,26. The aperture 22 is cut by machining methods or fabricated using etching technologies, e.g. on printed circuit board material or other suitable material that can be etched with sufficient accuracy.

A planar circular parasitic element 28, which is made from a conductive material, is located above and spaced apart from the lid 20 but is electro-magnetically coupled thereto. The parasitic element 28 can have any suitable shape, such as elliptical, circular disc, circular ring, square, spiral and can be planar, cylindrical, spherical, conical or saddle-shaped.

Array theory known to the applicant, stipulates that the maximum scan angle allowed before a grating lobe appears and rises above a specified value is determined by the spacing between the radiator elements 12.1. When the radiator elements 12.1 are packed closely together, i.e. with a smaller inter element spacing, a wider scan angle is achieved before the grating lobe appears. The selection of a shape of the cavity shell 16 is thus relatively important. Although suitable results are obtainable with elliptical or square or rectangular cavity shells, better results are obtained with round or hexagonal cavity shells as these enable a higher array density. Also, the structure formed by the cavity shell 16 and the lid 20 is non-resonant at operating frequencies, thereby allowing the maximum dimensions of the cavity shell 16 to be less than half a wavelength. A resonant cavity shell would have a cavity dimension of approximately or exceeding half a wavelength at operating frequencies. Such a large radiator dimension is disadvantageous in that in an array environment, the spacing of the radiator elements 12.1,12.2 would have to be larger than half a wavelength, consequently leading to a reduced allowable scan angle before the grating lobe would exceed specified levels.

To enable the spacing of the radiator elements 12.1,12.2 to be less than half a wavelength and still allow correct operation of the radiator elements 12.1,12.2, the slots 24,26 are respectively provided with opposite bent-off ends 24.1, 24.2 and 26.1,26.2.

Each slot 24,26 of the aperture 22 is respectively provided with two feed points 30,32 and 34,36 located relatively near to either or both of the opposite ends of the slots 24,26 corresponding to the chosen feed point impedance. The feed points 30,32,34,36 can be directly connected coaxial lines, stripline or microstrip lines. Coupled microstrip or stripline can also be used to excite either or both ends of the slots 24,26. In isolation from the array 10, the radiator element 12.1 is excited by providing the feed points 30,32,34,36 of the crossed aperture 22 with equal amplitude and balanced orthogonal phases (i.e. 0° 90° 180° 270°). This results in a balanced circular polarized pattern being formed. In the presence of the array the radiator element 12.1, which is nominally fed at the feed points 30,32,34,36 with balanced orthogonal phases of 0° 90° 180° 270°, is now fed with phase values varied to provide optimal circular polarisation of the radiated electromagnetic wave in the low elevation regions, namely below 30° above the horizon. This variation of the phases is to facilitate the in-phase addition of the electromagnetic radiation arising from the radiator elements 12.1 in a chosen direction. This variation of the values about their nominal "in isolation" design values arises from the mutual coupling between radiator elements 12.1 within the array. Because the effects of the mutual coupling are spatially dependent these phase variations can be chosen to work optimally in a certain region of the coverage hemisphere, improving the overall performance of the antenna.

Signal supply to the radiator elements 12.1 is provided from either a quadratic hybrid circuit, a resistive transmission line circuit or a reactive transmission line circuit 44, which is designed to supply the required amplitude and phases fed to the radiator feed points 30,32,34,36 of the slots 24,26.

The physical orientation of the radiator elements 12.1 within the array 10 with respect to each other is also chosen in such a way as to allow the manipulation of their mutual coupling and hence the radiation performance of each radiator element 12.1 embedded in the array.

Introducing the conductive parasitic element 28 above the lid 20 and transferring a circularly polarised signal between the aperture 22 in the lid 20 and the parasitic element 28 creates a resonance within the radiator element 12.1. This interaction between the cross aperture 22 and the parasitic element 28 allows the manipulation of the electromagnetic radiation pattern by varying the height above, shape of and size of the parasitic element 28. This in turn allows the manipulation of the overall gain of the antenna 10.

The parasitic elements 28 form an integral part of the coupling mechanism between the radiator elements 12.1, and as such can also be used to manipulate their mutual coupling and hence the overall electromagnetic radiation performance of the antenna 10 in a given direction.

This coupling mechanism can also be further manipulated by locating capacitive or inductive elements 38,40 between adjacent radiator elements 12.1. Alternatively further parasitic elements 42 can be located along an outer perimeter of the array. This has the advantage of causing the in-phase addition of the electromagnetic radiation arising from the operatively associated radiator elements 12.1 and thereby improving the overall performance of the antenna 10.

The capacitive or inductive elements 38,40 can be cylindrical or planar with any suitable shape, such as circular, rectangular, square, elliptical or hexagonal. The elements are normally either suspended between adjacent radiator elements 12.1, having no electrical contact other than mutual coupling, or they can be electrically contacted to either the cavity shell 16, the ground plane 14 or the lid 20.

The reactive transmission line circuit 44, which provides the required feed amplitude and phasing to the radiator element 12.1 has the further advantage of allowing the re-radiation of coupled energy instead of a quadratic hybrid or resistive transmission line circuit that dissipates all reflected or coupled power from adjacent radiator elements 12.1.

The placing of the reactive transmission line circuit 44 within the conductive cavity 18 of the radiator element 12.1 also facilitates direct coupling between the slots 24,26 and the transmission lines of the reactive transmission line circuit 44. This topology and location facilitates the correct phasing of mutual coupling terms and enhancing the radiation performance of the antenna 10.

The requirement of a low profile antenna having a small surface area normally results in poor directivity of the projected antenna radiation pattern towards low elevation angles. However using the above stated techniques, a travelling wave structure is created which allows the antenna 10 to radiate at low elevations between 0° to 30° relative to the horizon having a greater than 100% aperture efficiency. This travelling wave structure is formed by utilising the above techniques to optimise and manipulate the mutual coupling between radiator elements 12.1.

The antenna 10 can operate both as a receiving antenna as well as a transmitting antenna.

The invention claimed is:

1. An antenna system which includes a) an array structure provided with a plurality of radiator elements being adapted to transmit and receive radiated electromagnetic waves;

b) each radiator element being provided with at least two transverse interconnecting slots forming an aperture;

c) an array feed network operatively associated with each radiator element and being adapted to transmit a signal to and receive a signal from each radiator element and further being adapted to provide at least one common feed point for the array structure;

d) a phase shifting unit operatively joining each radiator element to its associated feed point, the phase shifting unit being adapted to selectively adjust a phase of the electromagnetic waves associated with each radiator element; and e) control means for regulating operation of each phase shifting unit and thereby controlling generation of a radiation pattern.

2. An antenna system as claimed in claim 1, in which the radiation pattern is a travelling wave array formation being adapted to enhance gain performance in lower elevation regions.

3. An antenna system as claimed in claim 2, in which the gain performance is enhanced when the travelling wave array formation is directed to within 30 degrees of its horizon.

4. An antenna system as claimed in claim 1, in which the array structure is substantially in the form of a hexagonal grid wherein adjacent radiator elements are spaced apart by less than half a wavelength of the electromagnetic waves.

5. An antenna system as claimed in claim 1, in which each radiator element is adapted to be circularly polarized and is further adapted to generate circularly polarized electromagnetic waves.

6. An antenna system as claimed in claim 1, in which each radiator element includes a shell forming a conductive cavity, the shell extending above a conductive ground plane.

7. An antenna system as claimed in claim 6, in which the ground plane is planar or non-planar.

8. An antenna system as claimed in claim 6, in which the conductive cavity has a depth less than a quarter of a wavelength of the electromagnetic waves.

9. An antenna system as claimed in claim 6, in which the conductive cavity has a diameter less than a half of a wavelength of the electromagnetic waves.

10. An antenna system as claimed in claim 1, in which the conductive cavity is circular cylindrical or hexagonal cylindrical in shape.

11. An antenna system as claimed in claim 1, in which each transverse slot has a length less than a half of a wavelength of the electromagnetic waves.

12. An antenna system as claimed in claim 1, in which each transverse slot is adapted to be operatively excited with at least one excitation point provided at least one end of each slot.

13. An antenna system as claimed in claim 1, in which each transverse slot is radially offset relative to each other associated slot and each slot being adapted to be excited with an appropriate phase relative to each other so as to generate circular polarization.

14. An antenna system as claimed in claim 13, in which two transverse slots are provided, one slot being orthogonally orientated relative to the other slot and the slots being adapted to be excited out of phase by 90 relative to each other so as to generate circular polarization.

15. An antenna system as claimed in claim 1, in which each radiator element includes a feed structure being adapted to excite each transverse slot.

16. An antenna system as claimed in claim 15, in which each feed structure includes a reactive transmission line circuit.

17. antenna system as claimed in claim 16, in which the transmission line circuit includes various transmission lines with different characteristics being adapted to achieve optimal circular polarisation of the radiation pattern when the array structure is directed to below 30 of its horizon.

18. An antenna system as claimed in claim 15, in which each feed structure is located within the conductive cavity of its associated radiator element.

19. An antenna system as claimed in claim 1, in which the array feed network includes a corporate configuration, a series configuration, or combination of a corporate and a series configuration.

20. An antenna system as claimed in claim 1, in which the phase shifting unit is adapted to permit spatial steering of the radiation pattern.

21. An antenna system as claimed in claim 1, in which each radiator element includes an operatively associated parasitic element.

22. An antenna system as claimed in claim 21, in which each parasitic element is located above the transverse slots of its associated radiator element.

23. An antenna system as claimed in claim 21, in which each parasitic element is provided in one of the following shapes: circular disc or ring, elliptical disc, square, spiral and which is formed into a planar, cylindrical, conical, spherical or saddle shape.

24. An antenna system as claimed in claim 21, in which the parasitic element size, shape and spacing is selected for suitably manipulating mutual electromagnetic coupling prevalent between adjacent radiator elements to thereby obtain a desired radiation pattern.

25. An antenna system as claimed in claim 1, which includes capacitive or inductive elements located between adjacent radiator elements and being adapted to manipulate mutual electromagnetic coupling prevalent between adjacent radiator elements to thereby obtain a desired radiation pattern.

26. An antenna system as claimed in claim 1, which includes capacitive or inductive elements located along an outer perimeter of the array structure and being adapted to manipulate mutual electromagnetic coupling prevalent between adjacent radiator elements to thereby obtain a desired radiation pattern.

27. A radiator element for use in an antenna system and being adapted to receive radiated electromagnetic waves, which radiator element includes a conductive ground plane; a shell forming a conductive cavity, the shell extending above the conductive ground plane and forming a wall spaced apart from the ground plane; at least two transverse slots provided in the wall and being adapted to form a crossed-slot aperture; and a parasitic element operatively associated with the transverse slots, wherein the radiator element is adapted to be circularly polarized and to generate circularly polarized electromagnetic waves, the ground plane is planar or non-planar, the conductive cavity has a depth less than a quarter of a wavelength of the electromagnetic waves, and the conductive cavity has a diameter less than a half of a wavelength of the electromagnetic waves.

28. A radiator element as claimed in claim 27, in which the conductive cavity is circular cylindrical or hexagonal cylindrical in shape.

29. A radiator element as claimed in claim 27, in which each transverse slot has a length less than a half of a wavelength of the electromagnetic waves.

30. A radiator element as claimed in claim 27, in which each transverse slot is adapted to be operatively excited with at least one excitation point provided at at least one end of each slot.

31. A radiator element as claimed in claim 27, in which each slot is radially offset relative to each other associated slot and each slot being adapted to be excited with an appropriate phase relative to each other so as to generate circular polarization.

32. A radiator element as claimed in claim 31, in which two transverse slots are provided, one slot being orthogonally orientated relative to the other slot and the slots being adapted to be excited out of phase by 90 relative to each other so as to generate circular polarization.

33. A radiator element as claimed in claim 27, which is provided with a feed structure being adapted to excite each transverse slot.

34. A radiator element as claimed in claim 33, in which each feed structure includes a reactive transmission line circuit.

35. A radiator element as claimed in claim 34, in which the transmission line circuit includes various transmission lines with varying characteristics obtained by varying the lengths of the transmission lines.

36. A radiator element as claimed in claim 33, in which each feed structure is located within the conductive cavity.

37. A radiator element as claimed in claim 27, in which the parasitic element is located above the transverse slots.

38. A radiator element as claimed in claim 27, in which the parasitic element is provided in one of the following shapes: circular disc or ring, elliptical disc, square, spiral, and which is formed into a planar, cylindrical, conical, spherical or saddle shape.

* * * * *